US009333762B2

(12) United States Patent
Hirakawa et al.

(10) Patent No.: US 9,333,762 B2
(45) Date of Patent: May 10, 2016

(54) INK JET RECORDING APPARATUS AND INK JET RECORDING METHOD

(75) Inventors: Ayumi Hirakawa, Kawasaki (JP); Takumi Kaneko, Tokyo (JP); Rie Takekoshi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 377 days.

(21) Appl. No.: 13/447,063

(22) Filed: Apr. 13, 2012

(65) Prior Publication Data

US 2012/0276293 A1 Nov. 1, 2012

(30) Foreign Application Priority Data

Apr. 27, 2011 (JP) ..... 2011-099695

(51) Int. Cl.

| | |
|---|---|
| ***B41J 2/21*** | (2006.01) |
| *B05D 5/06* | (2006.01) |
| *B05D 5/00* | (2006.01) |
| *B41J 11/00* | (2006.01) |

(52) U.S. Cl.

CPC ..... *B41J 2/2114* (2013.01); *B41J 11/0015* (2013.01); *B05D 5/00* (2013.01); *B05D 5/06* (2013.01); *B05D 5/066* (2013.01); *B41J 11/009* (2013.01); *B41M 2205/16* (2013.01); *B41M 2205/22* (2013.01)

(58) Field of Classification Search

CPC ..... B05D 5/00; B05D 5/06; B05D 5/066; B41J 11/009; B41M 2005/16; B41M 2205/22; B41M 2205/222

USPC ..... 427/258, 9, 14, 19, 95, 96, 100; 347/14, 347/19

See application file for complete search history.

(56) References Cited

U.S. PATENT DOCUMENTS

| | | | | |
|---|---|---|---|---|
| 8,474,934 | B1 * | 7/2013 | Curcio et al. | 347/9 |
| 2006/0017767 | A1 * | 1/2006 | Matsuzawa et al. | 347/21 |
| 2006/0059821 | A1 * | 3/2006 | Coghlan et al. | 52/455 |
| 2011/0032299 | A1 * | 2/2011 | Mimura | 347/15 |

FOREIGN PATENT DOCUMENTS

| | | | |
|---|---|---|---|
| JP | 2005-081754 | A | 3/2005 |
| JP | 2010-264730 | A | 11/2010 |
| JP | 2011-037015 | A | 2/2011 |

* cited by examiner

*Primary Examiner* — James M Mellott

(74) *Attorney, Agent, or Firm* — Canon USA, Inc. IP Division

(57) ABSTRACT

A recording method includes applying and overcoating. A color ink is applied to a region on a medium. A clear ink is applied to the region. The applied color ink and the applied clear ink are overcoated.

14 Claims, 12 Drawing Sheets

INK JET RECORDING APPARATUS AND INK JET RECORDING METHOD

BACKGROUND OF THE INVENTION

1. Field of the Invention

The present invention relates to the technique of ink jet recording, and more particularly to an ink jet recording method in which an ink image is overcoated with a clear ink.

2. Description of the Related Art

Japanese Patent Laid-Open No. 2005-081754 discloses a technique of applying a clear ink onto an ink image, which is formed on a recording medium in ink jet recording, to thereby overcoat the surface of the ink image with the clear ink. The overcoating can increase glossiness of the image and resistance against scratching (hereinafter referred to as "scratch resistance").

The state of the surface of the ink image before the overcoating differs depending on the type of ink used to form the ink image and the recording density of the ink. For example, as the recording density increases, dots of an ink having a small surface tension generally tend to easily immingle with one another, and the ink image after being fused and fixed forms a relatively smooth surface. On the other hand, dots of an ink having a great surface tension generally tend to form a surface having relatively noticeable irregularities because those dots are fused and fixed while keeping the dot shape. Color development irrelevant to the image may occur when overcoating the ink image that is formed by using the former ink tending to form the smooth surface. An interference color is generated through a mechanism described below.

FIG. 1 is a schematic view illustrating a cross-section of layers including a recording medium when a clear ink is coated on an ink image that is formed by the ink tending to form the smooth surface. An ink image layer 1002 recorded by using the ink is formed on a recording medium 1001, and a clear ink layer 1003 is formed on the ink image layer 1002. The clear ink layer 1003 generally has a thickness d of about 100 nm to 500 nm.

A parallel light 1004 (1004*a* and 1004*b*) from the sun or a fluorescent lamp, for example, is separated into a reflected light 1005 that is reflected at the surface of the clear ink layer 1003, and a reflected light 1006 that is reflected at the surface of the ink image layer 1002 after passing through the clear ink layer 1003. Interference occurs between the two separated lights due to a difference in optical path therebetween.

Given, for example, that the incident angle is θ, the wavelength of incident light is λ, and the refractive index of the clear ink layer 1003 is n, the intensity of light having the wavelength λ, which satisfies the relationship expressed by the following formula (1), is increased and an interference color of the relevant light is more strongly visually recognized by an observer:

$$m\times\lambda=n\times 2d\times\cos\theta+\lambda/2 \quad (m\text{: natural number}) \tag{1}$$

The wavelength λ satisfying the formula (1) varies depending on a thickness d of the clear ink layer 1003. Therefore, when the thickness of the clear ink layer 1003 is not uniform, the rainbow-colored reflected light may be recognized by the observer in some cases. Such color development irrelevant to an ink image degrades quality of the ink image.

Thus, the ink image having the smooth surface coated with the clear ink is tinted by the interference light having a particular color and is visually recognized as a color tone that has changed from the original color tone of the ink image.

The interference color generated through the above-described mechanism is more conspicuous in a primary color region with a particular ink. In the primary color region, when dots of the same type of ink are applied to the recording medium in closely adjacent relation, those dots tend to easily immingle with one another because of high affinity and to form a smooth ink layer on the surface of the recording medium.

SUMMARY OF THE INVENTION

The present invention has been made in view of the above-described problems with the related art. Embodiments of the present invention provide an ink jet recording method and an ink jet recording apparatus, which can suppress generation of an interference color regardless of the type of ink and the recording density by controlling a surface shape of an ink image before the ink image is overcoated with a clear ink.

According to an aspect of the present invention, a recording method includes applying a color ink to a region on a medium, applying a clear ink to the region, and overcoating the applied color ink and the applied clear ink.

According to another aspect of the present invention, a recording apparatus includes a first applying unit configured to apply a color ink to a region on a medium, a second applying unit configured to apply a clear ink to the region, and an overcoating unit configured to overcoat the applied color ink and the applied clear ink.

According to the embodiments of the present invention, in an output print obtained by overcoating the clear ink on an image, light interference at a clear ink layer can be inhibited regardless of the type of the used ink from causing color development irrelevant to the image.

Further features of the present invention will become apparent from the following description of exemplary embodiments with reference to the attached drawings.

DESCRIPTION OF THE EMBODIMENTS

As mentioned above, when the thickness d of the clear ink layer satisfies the formula (1) at a wavelength of visible light, an interference color is visually recognized with the light having the relevant wavelength. However, when irregularities formed on the surface of an ink image are fairly noticeable as illustrated in FIG. 12D, the thickness d of the clear ink layer varies such that lights having various wavelengths are intensified by interference. Since the interference lights having various wavelengths are summed up, the interference color is visually recognized as white.

In consideration of such a mechanism, according to an embodiment of the present invention, irregularities are formed on the surface of the ink image before overcoating, to thereby avoid the interference color from being visually recognized with the intensified interference of only light having a particular wavelength.

The embodiment of the present invention will be described in detail below.

Figure 1:
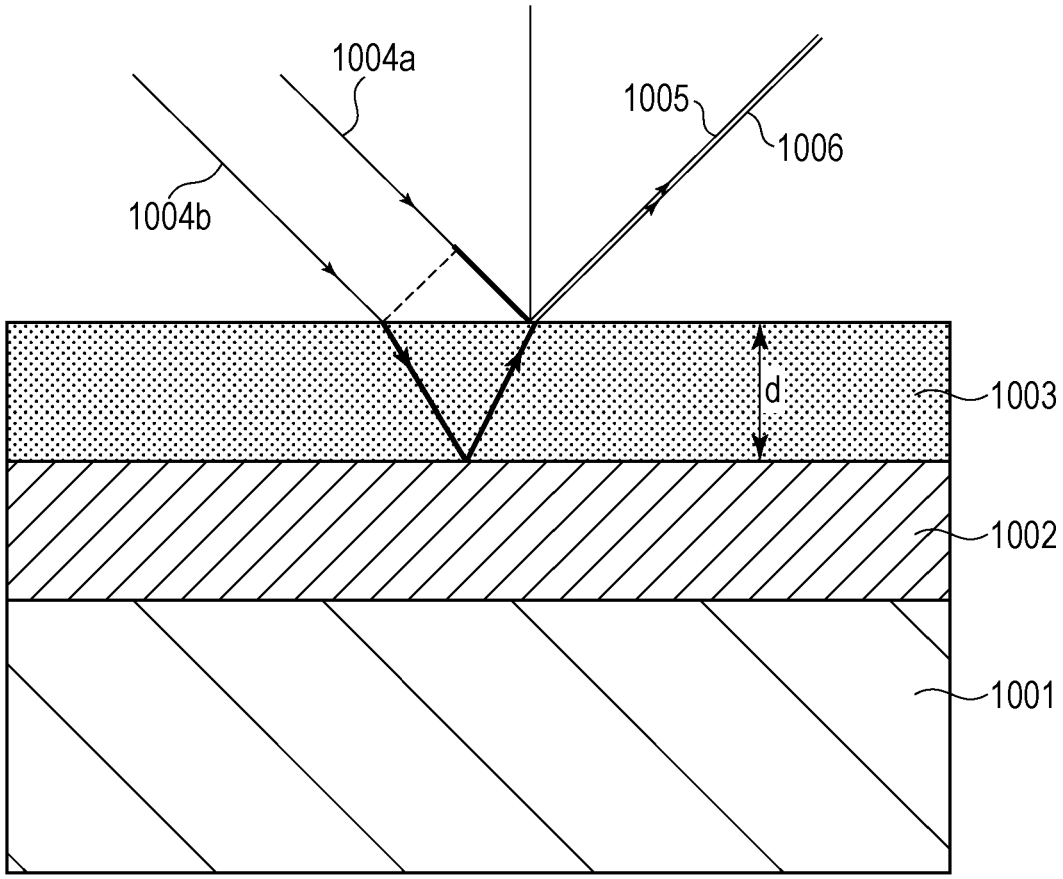
FIG. 1 is a sectional view illustrating a mechanism generating an interference color.
Figure 2:
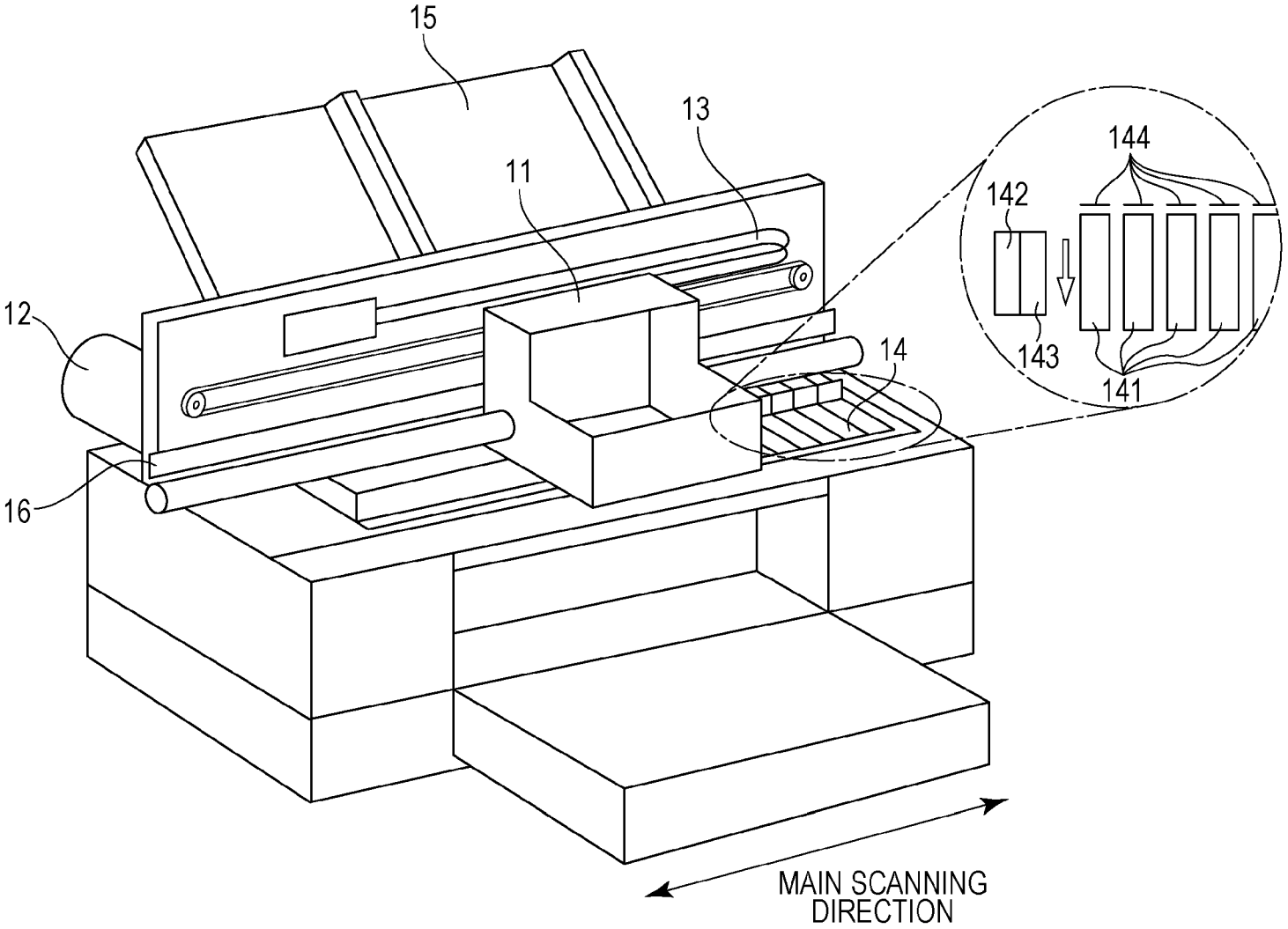
FIG. 2 is a perspective view of an ink jet recording apparatus used in an embodiment.

FIG. 2 is a perspective view of an ink jet recording apparatus used in the embodiment. An ink jet head including inks in plural colors is mounted to a carriage 11, and the carriage 11 is reciprocally scanned in a main scanning direction by using a carriage motor 12 as a driving source. A flexible cable 13 attached to be able to follow the reciprocal scanning of the carriage 11 transfers an electrical signal between a control unit (not illustrated) and the ink jet head mounted to the carriage 11. A position of the moving carriage 11 is detected by an encoder sensor, which is included in the carriage 11, optically reading an encoder 16 attached to extend in the main scanning direction.

When a recording operation command is input from a host apparatus externally connected, one sheet of recording media stacked in paper feed tray 15 is fed to a position where an image can be recorded on the recording medium by the ink jet head mounted to the carriage 11. The carriage motor 12 serves to drive the ink jet head in the main scanning direction. The image is then formed by alternately repeating the main scanning of the ink jet head while the inks are discharged in accordance with recording signals, and an operation of conveying the recording medium through a predetermined distance, thus scanning the ink jet head over a unit region on the recording medium plural times.

A recovering unit 14 for executing a maintenance process of the ink jet head is provided at the end of an area in which the carriage 11 is movable. The recovering unit 14 includes, for example, caps 141 for protecting discharge port surfaces of the ink jet head when the inks are sucked and when the inks are left in the unused state, a discharge receiver 142 for receiving a coating liquid (clear ink) when it is discharged for recovery, and a discharge receiver 143 for receiving the ink when it is discharged for recovery. Wiper blades 144 wipe the discharge port surfaces of the ink jet head, respectively, while moving in a direction denoted by an arrow.

Figure 3:
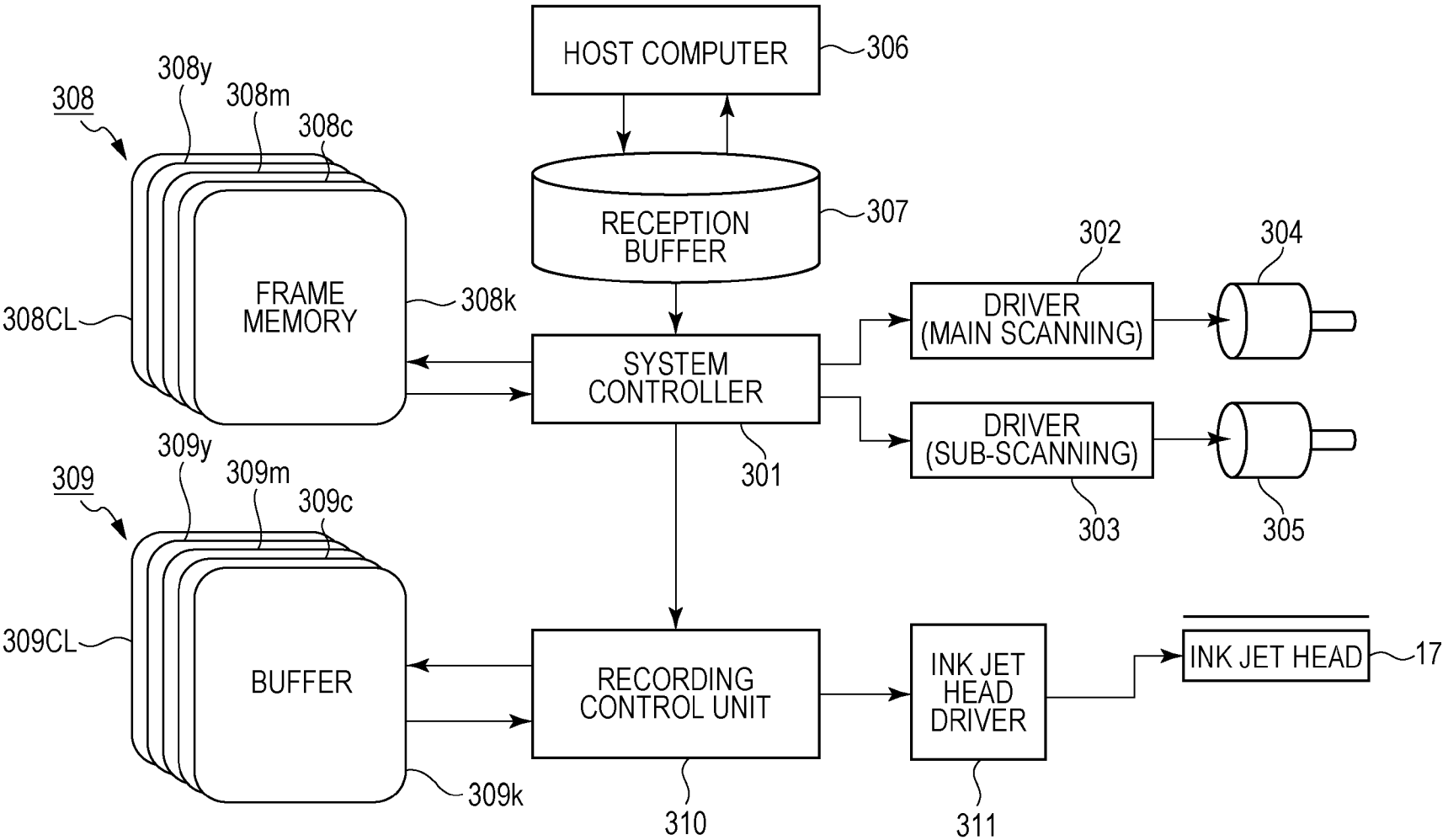
FIG. 3 is a block diagram illustrating a control unit of the ink jet recording apparatus used in the embodiment.

FIG. 3 is a block diagram illustrating a control unit of the ink jet recording apparatus used in the embodiment. In FIG. 3, a system controller 301 processes received image data and controls the entirety of the apparatus. The system controller 301 includes therein a microprocessor, control programs and mask patterns, a storage device (ROM), and a RAM serving as a work area used to execute various types of image processing. Drivers 302 and 303 receive information, such as respective moving speeds and moving distances of an ink jet head 17 and the recording medium, from the system controller 301 and drive motors 304 and 305, respectively. An externally connected host computer 306 transfers image information, which is to be recorded, to the ink jet recording apparatus of the embodiment. The host computer 306 may be in the form of, for example, a computer serving as an information processing apparatus, or an image reader. A reception buffer 307 temporarily stores data received from the host computer 306 and keeps the received data therein until the data is read by the system controller 301. Frame memories 308 (308*k*, 308*c*, 308*m*, 308*y* and 308*c*1) are used to render (develop) the data to be recorded into image data, and they have a memory size with a capacity required to perform the recording for each ink color. While the frame memory capable of recording data corresponding to one sheet of the recording medium is prepared in the embodiment, the memory size is not limited to such an example. Buffers 309 (309*k*, 309*c*, 309*m*, 309*y* and 309*c*1) temporarily store, for the respective ink colors, the data to be recorded, and their storage capacity is changed depending on the number of nozzles of the ink jet head 17. A recording control unit 310 controls the ink jet head 17 in accordance with a command from the system controller 301, thereby appropriately controlling the recording speed, the number of recorded data, etc. An ink jet head driver 311 is controlled in accordance with a signal from the recording control unit 310, and it drives the ink jet head 17 from which the inks are discharged. In the configuration described above, the image data supplied from the host computer 306 is transferred to the reception buffer 307 and is temporarily stored therein. The image data is then developed into the frame memories 308 for each color by the system controller 301. The developed image data is read by the system controller 301 and is subjected to the predetermined image processing. Thereafter, the image data is stored in the buffers 309 for each color. The recording control unit 310 controls the operation of the ink jet head 17 in accordance with the image data in each buffer.

(Head Construction)

Figure 4:
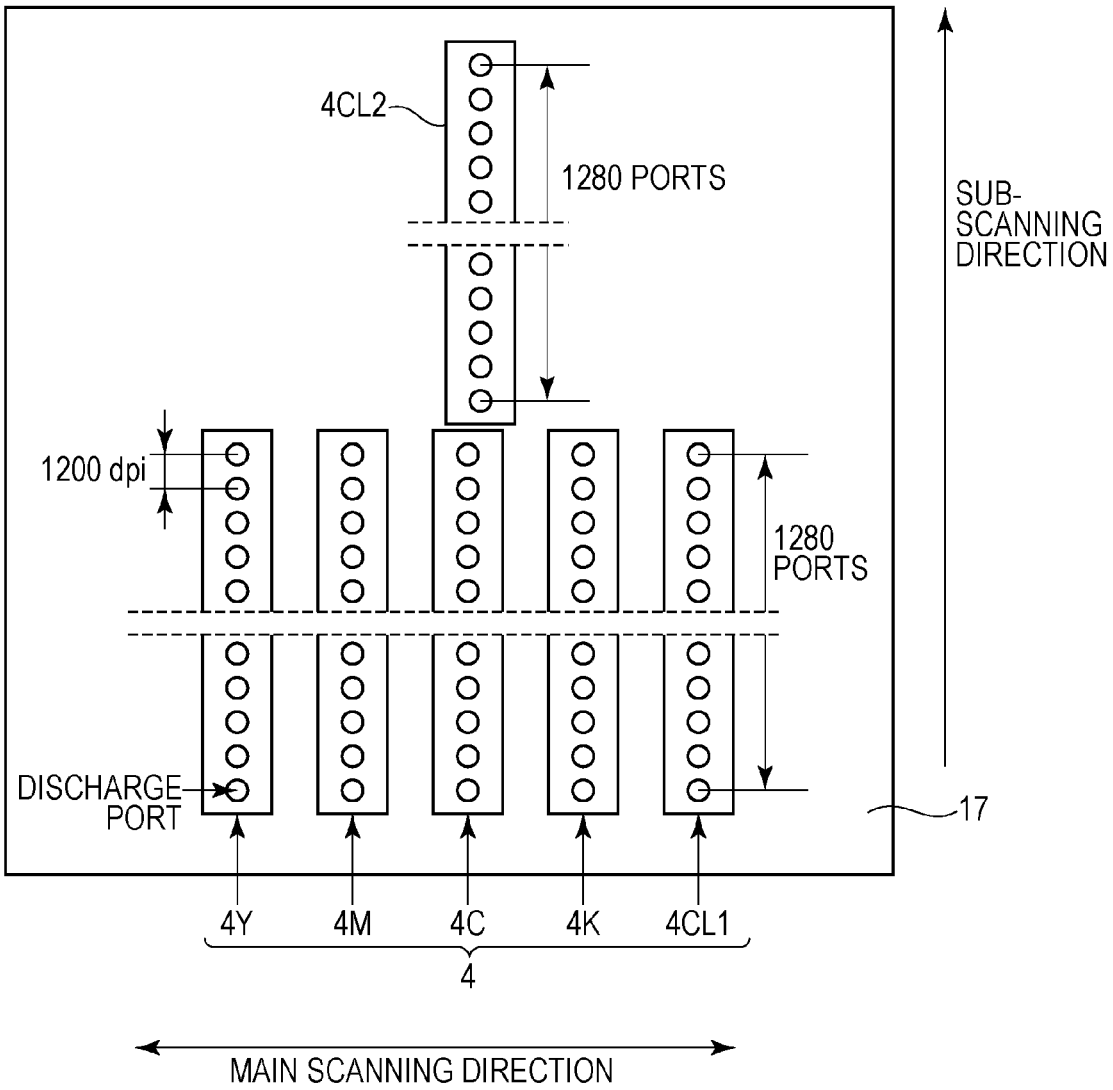
FIG. 4 is a schematic view illustrating, as viewed from the discharge port side, the construction of an ink jet head used in the embodiment.

FIG. 4 is a schematic view illustrating, as viewed from the discharge port side, the construction of the ink jet head 17 used in the embodiment. In the ink jet head 17, a discharge port row for one color is formed by a number 1280 of discharge ports that are arrayed in a sub-scanning direction at a density of 1200 ports per inch, and the discharge port row is arranged plural side by side in the main scanning direction in number corresponding to the ink colors. In the embodiment, a discharge port row 4K discharging a black ink, a discharge port row 4C discharging a cyan ink, a discharge port row 4M discharging a magenta ink, a discharge port row 4Y discharging a yellow ink, and a discharge port row 4CL1 discharging a clear ink are arranged in order as per illustrated. A discharge port row 4CL2 discharging the clear ink is further arranged downstream of those discharge port rows for the five types of inks (hereinafter referred to as the "upstream-side discharge port rows") in the sub-scanning direction. The discharge port row 4CL2 (hereinafter referred to as the "downstream-side discharge port row") is used to overcoat the clear ink on the surface of the ink image, which has been formed by the inks discharged from the upstream-side discharge port rows, for the purpose of increasing the scratch resistance, etc. of the ink image. The ink is discharged from each discharge port as a liquid droplet of about 4.5 pl. However, a discharge amount of the black ink may be set to a grater value than that of the other ink in order to realize a black image at a higher density. In the recording apparatus according to the embodiment, dots are recorded at the recording density of 2400 dpi (dots/inch; reference value) in the main scanning direction and 1200 dpi in the sub-scanning direction by discharging the inks while the ink jet head 17 is scanned in the main scanning direction.

(Ink Composition)

Components and a purification method of an ink set employed in the embodiment will be described below. In the following description, "part" and "%" are each on the basis of mass unless otherwise specified.

<Yellow Ink>

(1) Preparation of Dispersion Liquid

10 Parts of a pigment, 30 parts of an anionic high polymer, and 60 parts of pure water, given below, are mixed with one another.

Pigment: [C.I. Pigment Yellow 74 (product name: Hansa Brilliant Yellow 5GX (made by Clariant))

Anionic high polymer P-1: [styrene/butylacrylate/acrylic acid copolymer (copolymerization ratio (ratio by weight) =30/40/30), acid value 202, weight-average molecular weight 6500, aqueous solution with 10% of solid content, and neutralizer: potassium hydroxide]

Then, the foregoing materials are loaded into a batch-type vertical sand mill (made by IMEX Co., Ltd.) and are subjected to dispersion treatment for 12 hours under water cooling with 150 parts of zirconia beads of 0.3-mm diameter put in the sand mill. A resulting dispersion liquid is further subjected to a centrifugal separator to remove coarse particles. A pigment dispersion liquid 1 having a solid content of about 12.5% and a weight-average particle diameter of 120 nm is obtained as a finally prepared substance. By using the pigment dispersion liquid thus obtained, a yellow ink is prepared as follows.

(2) Preparation of Ink

After sufficiently mixing, dissolving and dispersing the following components with one another under agitation, a resulting mixture is filtrated under pressure by using a micro-filter (made by Fujifilm Corporation) having a pore size of 1.0 μm, whereby a yellow ink 1' is prepared.

Pigment dispersion liquid 1 obtained above: 40 parts

Glycerin: 9 parts

Ethylene glycol: 6 parts

Acetylene glycol ethylene oxide (EO) adduct (product name: Acetylenol EH): 1 part 1,2-Hexanediol: 3 parts Polyethylene glycol (molecular weight 1000): 4 parts Water: 37 parts <Magenta Ink>

(1) Preparation of Dispersion Liquid

An AB-type block polymer having an acid value of 300 and a number-average molecular weight of 2500 is prepared with an ordinary method by using benzyl acrylate and methacrylic acid as materials. The AB-type block polymer is neutralized by an aqueous solution of potassium hydroxide and is diluted with ion-exchange water, whereby a homogeneous aqueous solution containing 50% by mass of the above-mentioned polymer is prepared. Further, 100 g of the polymer solution, 100 g of C.I. Pigment Red 122, and 300 g of ion-exchange water are mixed with one another. A resulting mixture is mechanically agitated for 0.5 hour. Next, the mixture is processed by using a micro-fluidizer and by causing the mixture to pass through an interaction chamber five times under liquid pressure of about 70 MPa. A thus-obtained dispersion liquid is subjected to a centrifugal separation process (at 12,000 rpm for 20 minutes) to remove non-dispersed matters including coarse particles, whereby a magenta dispersion liquid is obtained. The magenta dispersion liquid thus obtained has a pigment concentration of 10% by mass and a dispersant concentration of 5% by mass.

(2) Preparation of Ink

A magenta ink is prepared by using the magenta dispersion liquid obtained above. After adding the following components to the magenta dispersion liquid at a predetermined concentration and sufficiently mixing them with one another under agitation, a resulting mixture is filtrated under pressure by using a micro-filter (made by Fujifilm Corporation) having a pore size of 2.5 μm, whereby the magenta ink having a pigment concentration of 4% by mass and a dispersant concentration of 2% by mass is prepared.

Magenta dispersion liquid obtained above: 40 parts

Glycerin: 10 parts

Diethylene glycol: 10 parts

Acetylene glycol EO adduct: 0.5 part

Ion-exchange water (made by Kawaken Fine Chemicals Co., Ltd.): 39.5 parts

<Cyan Ink>

(1) Preparation of Dispersion Liquid

An AB-type block polymer having an acid value of 250 and a number-average molecular weight of 3000 is prepared with an ordinary method by using benzyl acrylate and methacrylic acid as materials. The AB-type block polymer is neutralized by an aqueous solution of potassium hydroxide and is diluted with ion-exchange water, whereby a homogeneous aqueous solution containing 50% by mass of the polymer is prepared. Further, 180 g of the polymer solution, 100 g of C.I. Pigment Blue 15:3, and 220 g of ion-exchange water are mixed with one another. A resulting mixture is mechanically agitated for 0.5 hour. Next, the mixture is processed by using a micro-fluidizer and by causing the mixture to pass through an interaction chamber five times under liquid pressure of about 70 MPa. A thus-obtained dispersion liquid is subjected to a centrifugal separation process (at 12,000 rpm for 20 minutes) to remove non-dispersed matters including coarse particles, whereby a cyan dispersion liquid is obtained. The cyan dispersion liquid thus obtained has a pigment concentration of 10% by mass and a dispersant concentration of 10% by mass.

(2) Preparation of Ink

A cyan ink is prepared by using the cyan dispersion liquid obtained above. After adding the following components to the cyan dispersion liquid at a predetermined concentration and sufficiently mixing them with one another under agitation, a resulting mixture is filtrated under pressure by using a micro-filter (made by Fujifilm Corporation) having a pore size of 2.5 μm, whereby the cyan ink having a pigment concentration of 2% by mass and a dispersant concentration of 2% by mass is prepared.

Cyan dispersion liquid obtained above: 20 parts

Glycerin: 10 parts

Diethylene glycol: 10 parts

Acetylene glycol EO adduct: 0.5 part

Ion-exchange water (made by Kawaken Fine Chemicals Co., Ltd.): 53.5 parts

<Black Ink>

(1) Preparation of Dispersion Liquid

100 G of the polymer solution used in preparing the yellow ink 1', 100 g of carbon black, and 300 g of ion-exchange water are mixed with one another. A resulting mixture is mechanically agitated for 0.5 hour. Next, the mixture is processed by using a micro-fluidizer and by causing the mixture to pass through an interaction chamber five times under liquid pressure of about 70 MPa. A thus-obtained dispersion liquid is subjected to a centrifugal separation process (at 12,000 rpm for 20 minutes) to remove non-dispersed matters including coarse particles, whereby a black dispersion liquid is obtained. The black dispersion liquid thus obtained has a pigment concentration of 10% by mass and a dispersant concentration of 6% by mass.

(2) Preparation of Ink

A black ink is prepared by using the black dispersion liquid obtained above. After adding the following components to the black dispersion liquid at a predetermined concentration and sufficiently mixing them with one another under agitation, a resulting mixture is filtrated under pressure by using a micro-filter (made by Fujifilm Corporation) having a pore size of 2.5

μm, whereby the black ink having a pigment concentration of 5% by mass and a dispersant concentration of 3% by mass is prepared.

Black dispersion liquid obtained above: 50 parts

Glycerin: 10 parts

Triethylene glycol: 10 parts

Acetylene glycol EO adduct: 0.5 part

Ion-exchange water (made by Kawaken Fine Chemicals Co., Ltd.): 25.5 parts

<Clear Ink>

(1) Preparation of Resin Solution

A resin aqueous solution is obtained as follows. After adding 15.0% by mass of a resin made up of styrene and acrylic acid, one equivalent weight of potassium hydroxide with respect to carboxylic acid constituting the acrylic acid, and water as the rest for adjustment to 100.0% by mass, they are agitated at 80° C. to dissolve the resin. The resin aqueous solution is then obtained by adjusting the composition with water such that the solid content is 15.0% by mass. The resin has a weight-average molecular weight of 7,000.

(2) Preparation of Ink

A clear ink is prepared by sufficiently mixing the following components with one another under agitation. The obtained clear ink is colorless and clear.

Resin aqueous solution: 26.6 parts

Glycerin: 9 parts

Ethylene glycol: 6 parts

Acetylene glycol EO adduct: 1 part (Image Processing)

Figure 5:
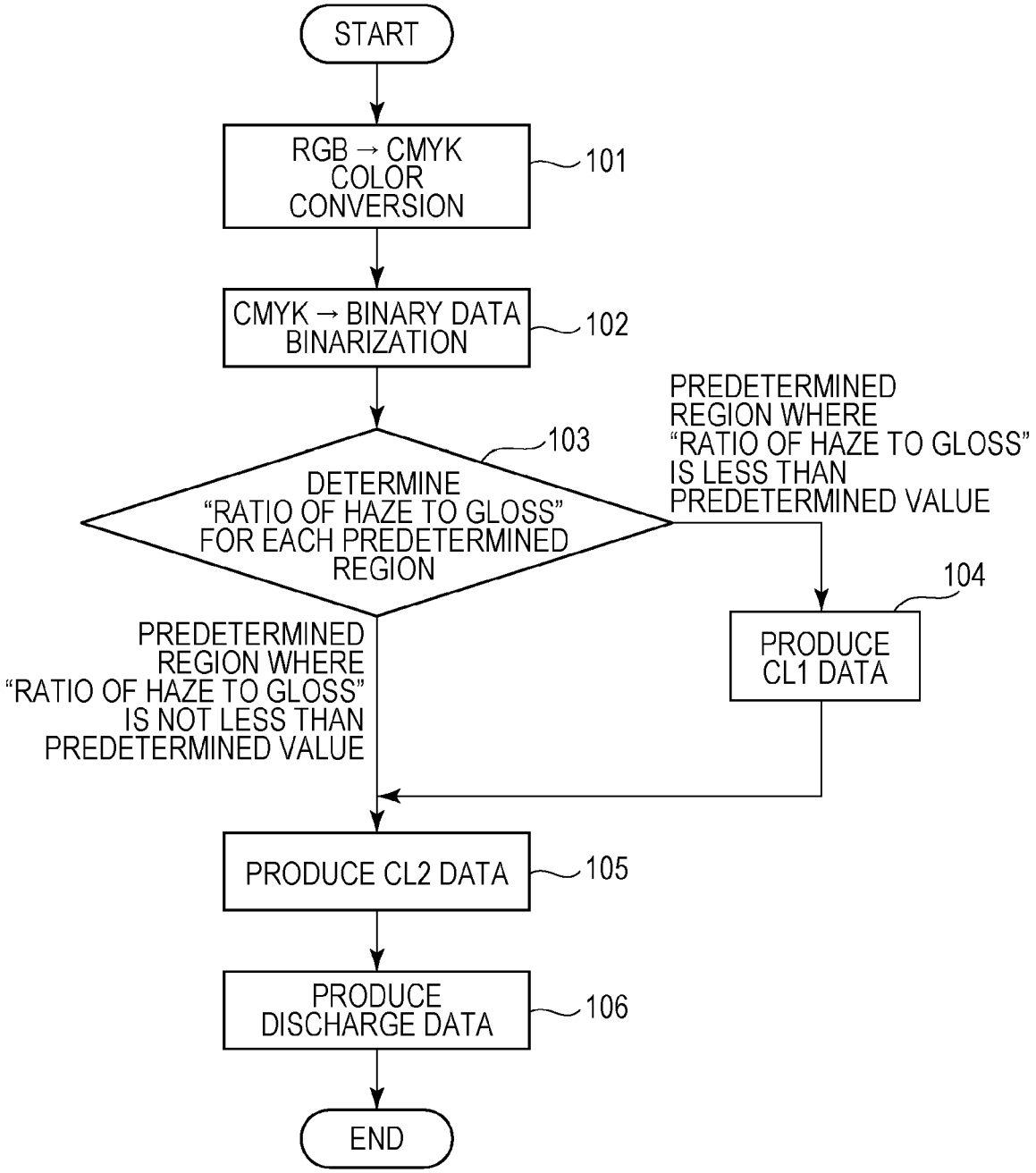
FIG. 5 is a flowchart to explain image processing executed in the embodiment.

Multi-valued image data in the RGB format is input from the host computer (image input unit) in accordance with a processing flow illustrated in FIG. 5. When the image data is input, the multi-valued image data in the RGB format is converted, through color conversion in step 101, to multi-valued image data corresponding to color inks (C, M, Y, K) that are used in image formation. Thereafter, in accordance with patterns stored in advance, the multi-valued image data corresponding to the color inks is rendered to binary image data for each of the color inks. (Step 102)

On the basis of the binary image data obtained in step 102, an image is divided into a plurality of regions, i.e., plural unit regions, and an index (ratio of haze to gloss) for surface smoothness is obtained in relation to an ink image that is to be formed in each unit region. It is then determined whether the obtained haze-to-gloss ratio is not less than a predetermined threshold (0.35 in the embodiment). (Step 103)

Here, the terms "gloss", "haze", and "ratio of haze to gloss" used in this specification are defined as follows.

(Definition of Gloss and Haze)

The "gloss" implies a value of gloss (glossiness), which is measured in conformity with the method stipulated in JIS K 5600-4-7, and it provides an index for the intensity of specular reflected light (i.e., light reflected at a reflection angle of (incident angle+0±0.9°)).

The "haze" implies a value of haze, which is measured in conformity with the method stipulated in ISO DIS 13803, and it provides an index for the intensity of diffuse reflected light (i.e., light reflected at a reflection angle of (incident angle+1.8±0.9°)).

The "ratio of haze to gloss" implies a value calculated by division of haze/gloss. The "ratio of haze to gloss" is also generally called "image clarity". A smaller "ratio of haze to gloss" is equivalent to "higher image clarity", and it implies a smoother surface. Conversely, a greater "ratio of haze to gloss" is equivalent to "lower image clarity", and it implies a rougher surface. Therefore, a "high gloss surface" implies a "surface having a small ratio of haze to gloss", i.e., a "smooth surface".

The Micro-Haze Plus made by BYK-Gardner is used to separately measure respective values of the gloss and the haze of various color inks. It is to be noted that a measuring device is not limited to the Micro-Haze Plus insofar as it can measure respective values of the gloss and the haze of various color inks.

$$\text{"Ratio of haze to gloss"} = \text{"value of haze"} / \text{"value of gloss"} \quad (2)$$

Figure 6:
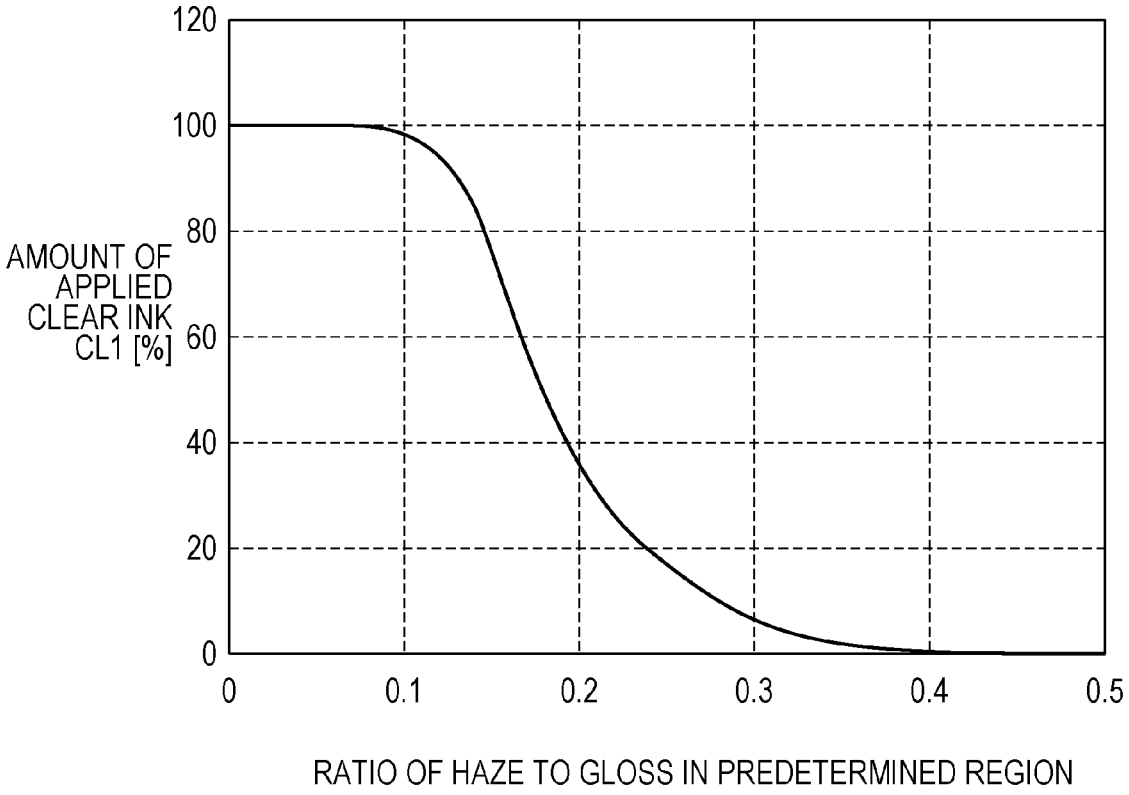
FIG. 6 is a graph depicting an amount of applied clear ink with respect to a ratio of haze to gloss.

For a region where the "ratio of haze to gloss" obtained in step 103 is estimated to be less than 0.35, the processing flow advances to step 104 in which an amount of clear ink (CL1) applied to form more irregularities is set. The amount of the applied clear ink (CL1) is set on the basis of a graph, depicted in FIG. 6, plotting the amount of the applied clear ink with respect to the "ratio of haze to gloss".

For example, in Table 1 given later, the "ratio of haze to gloss" in the primary color region of yellow where the recording density is 100% is 0.24, i.e., less than the predetermined threshold of 0.35. Accordingly, the amount of the clear ink applied in a second step (specified in Claim 1) is determined to be 20% (recording density) from the graph of FIG. 6.

On the other hand, for a region where the "ratio of haze to gloss" is estimated to be not less than 0.35, the processing flow advances to step 105 in which an amount of clear ink (CL2) applied for overcoating is set.

The amount of the applied clear ink (CL2) is set as appropriate depending on the purpose of use of an ink image. As the thickness of the clear ink increases, a longer wavelength satisfies the formula (1) and the interference color is generally shifted from light of a shorter wavelength to light of a longer wavelength. If the thickness of the clear ink exceeds about 500 nm, the wavelength satisfying the formula (1) is not present in the visible range. Therefore, the interference color is not visually recognized regardless of a degree of smoothness of the surface of the ink image before the overcoating. Also, if the thickness of the clear ink is smaller than about 100 nm, the wavelength satisfying the formula (1) is not present in the visible range and the interference color is not visually recognized. However, a clear ink layer having a certain thickness is required to obtain a proper gloss, whereas a larger thickness of the clear ink layer increases a cost because of consuming the clear ink in a larger amount. For that reason, in one embodiment, the clear ink layer is formed in the range of 100 nm to 400 nm.

After obtaining the amount of each of all the inks applied to form the image, including the clear ink, for each region in steps 104 and 105, the processing flow advances to step 106 in which discharge data for forming the image is produced.

In the embodiment, as described above, the predetermined threshold is set to 0.35 for the "ratio of haze to gloss" in the ink image before the overcoating. Further, because the above-mentioned problem of the interference color is less apt to occur in a region where an image of a secondary or higher-order color is formed, a control process of forming the irregularities by using the clear ink is performed only in the primary color region in the embodiment.

The reason why the secondary or higher-order color region is less apt to form a smooth surface resides in that, even when ink dots having different compositions are present adjacent to each other, inks are not easily immingled and they keep dot shapes, whereby irregularities remain.

While, in the embodiment, the "ratio of haze to gloss" for each unit region is obtained to perform the control process of applying the clear ink, the "ratio of haze to gloss" may be obtained in terms of the type of ink used and the recording density of the ink.

The "ratio of haze to gloss" is substantially uniquely defined corresponding to the type of ink applied to the region where the control process is performed and the recording density of the applied ink. Therefore, the embodiment can be modified in a manner of previously storing, in a memory of the recording apparatus, a table that specifies the "ratio of haze to gloss" corresponding to the type of ink used and the recording density of the ink.

(Recording Step)

In the embodiment, multi-pass recording of 8 passes is performed by using the ink jet head illustrated in FIG. 4. The multi-pass recording will be described in brief below.

In the multi-pass recording, an image is completed step by step by obtaining image data, which can be recorded by the ink jet head in one cycle of main scanning, through thinning in accordance with a mask pattern prepared in advance, and by performing the main scanning plural times.

Figure 7:
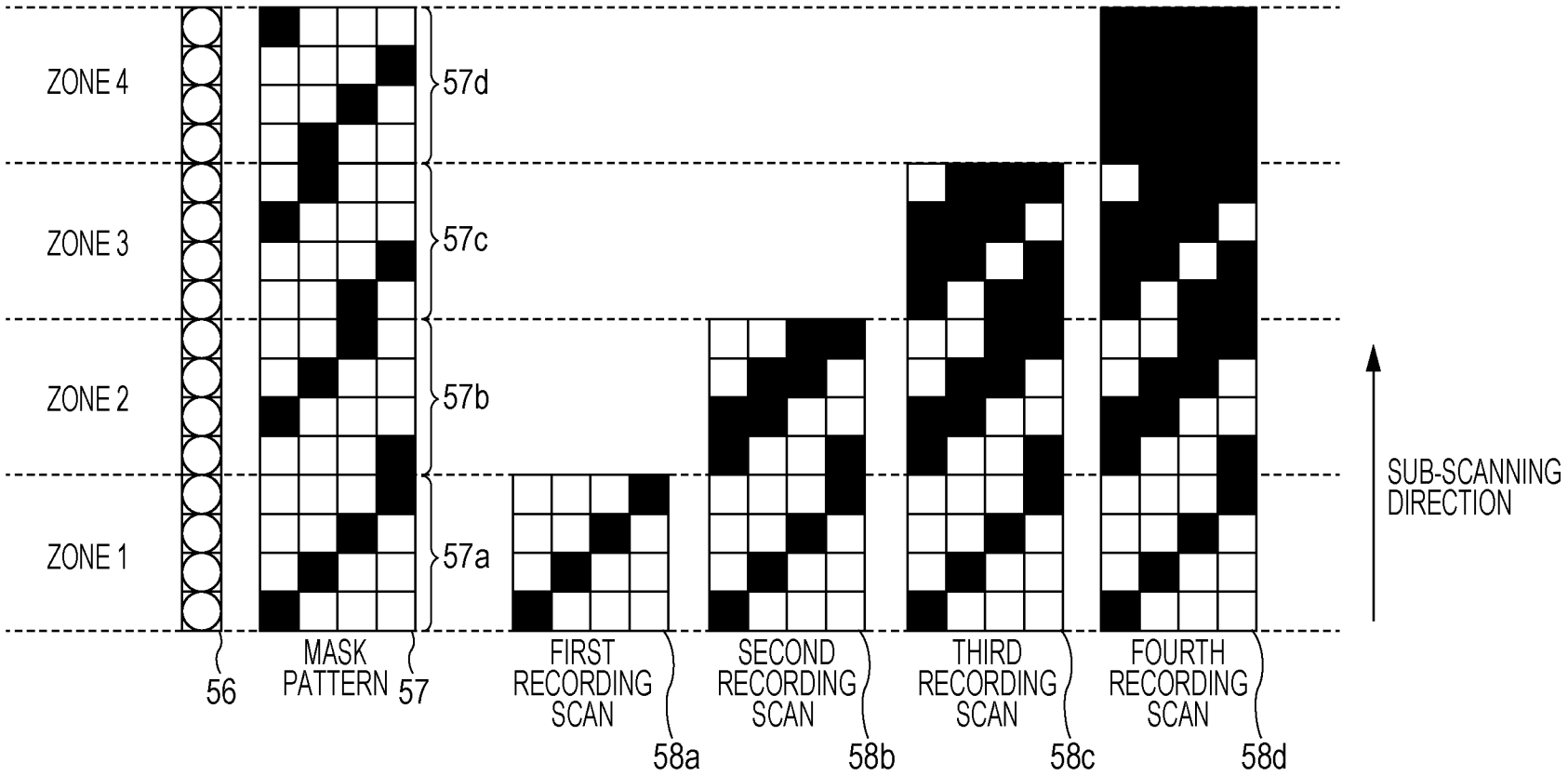
FIG. 7 is a schematic view to explain a multi-pass recording method in brief.

FIG. 7 is a schematic view to explain a multi-pass recording method in brief. For the sake of simplicity, the following description is made in connection with the case where the multi-pass recording of 4 passes is performed by using a discharge port row 56 having 16 discharge ports. In the case of the multi-pass recording of 4 passes, the discharge port row 56 can be considered in the following discussion as being divided into four zones (zone 1 to zone 4) each having 4 discharge ports.

Reference symbols 57*a* to 57*d* denote mask patterns assigned respectively to the zone 1 to the zone 4. Each of the mask patterns 57*a* to 57*d* has a region of 4 pixels×4 pixels in which recording permissive pixels are defined as indicated by black and non-recording permissive pixels are defined as indicated by white. The recording permissive pixels are completed in a complementary manner by imposing the mask patterns 57*a* to 57*d* one above another. When the recording is actually performed, a logical product (AND) operation is executed between image data (recording/non-recording data) assigned to the individual discharge ports and the mask patterns, and a discharge operation is executed on the basis of the logical AND result. While the mask pattern having the region of 4 pixels×4 pixels is used here for the sake of simplicity, an actual mask pattern has a larger number of regions in each of the main scanning direction and the sub-scanning direction.

Reference symbols 58*a* to 58*d* illustrate successive steps through which the image is gradually completed on the recording medium by repeating a recording scan. In each recording scan, the zones 1 to 4 of the discharge port row 56 perform recording only on the pixels for which the recording is permitted by the mask patterns 57*a* to 57*d*. Whenever each recording scan is finished, the recording medium is conveyed in the sub-scanning direction through a distance corresponding to the width of each region. In such a manner, the image in the unit region of the recording medium (i.e., in a region of the recording medium corresponding to the width of each zone of the discharge port row) is completed with four recording scans. According to the multi-pass recording described above, the image in each unit region of the recording medium is recorded with plural scans by using the plural zones of the discharge port row. Therefore, variations attributable to the discharge ports (nozzles), variations in accuracy of conveying the recording medium are distributed, whereby density variations and striped unevenness can be reduced.

For the sake of simplicity, the above description is made, for example, in connection with the multi-pass recording of 4 passes by referring to FIG. 7. When the multi-pass recording of 8 passes is performed as in the embodiment, one discharge port row may be divided into eight zones, and mask patterns in complementary relation may be assigned to the eight zones, respectively. In those mask patterns, an array of the recording permissive pixels may be variously changed insofar as the complementary relation among the regions of the mask patterns is kept. For example, when plural discharge port rows are disposed corresponding to the types of inks as in the embodiment, the mask patterns may be made different from each other corresponding to the types of inks.

Figure 8A:
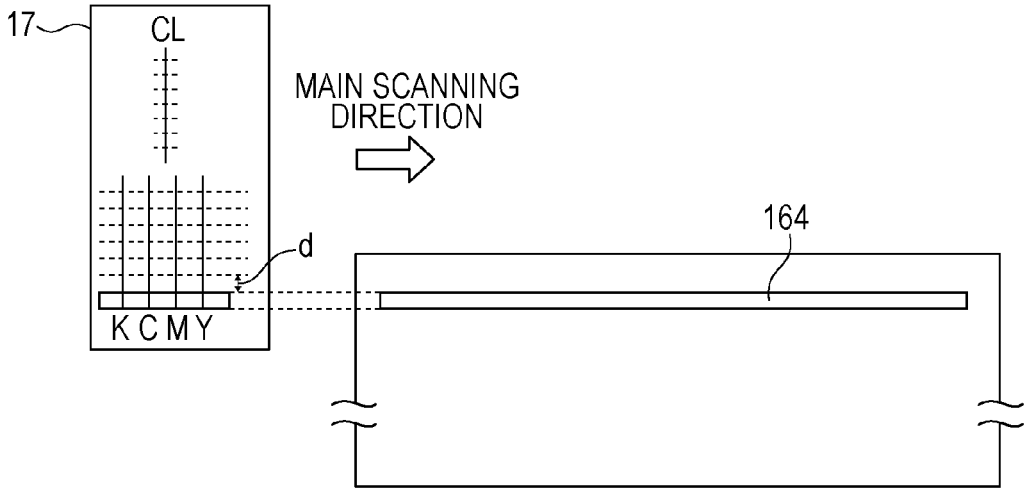
FIGS. 8A to 8C are illustrations depicting a recording state with the multi-pass recording of 8 passes.
Figure 8B:
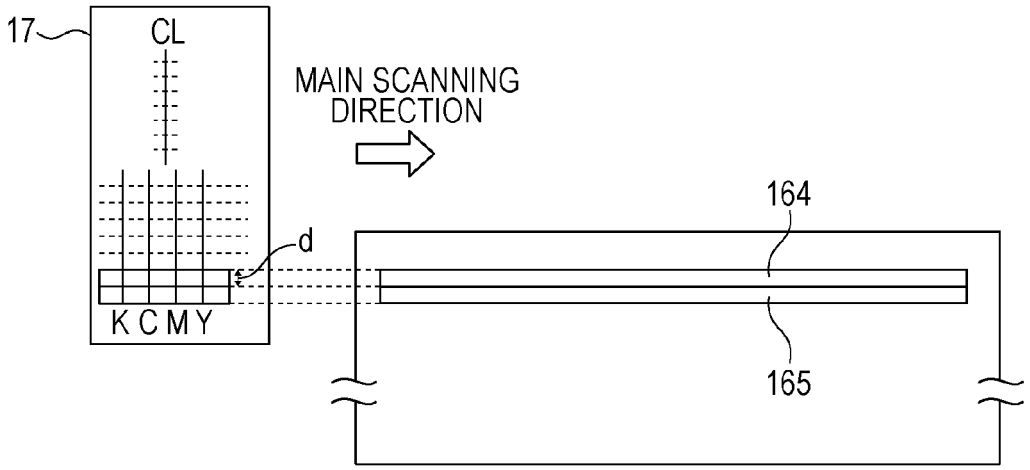
Figure 8C:
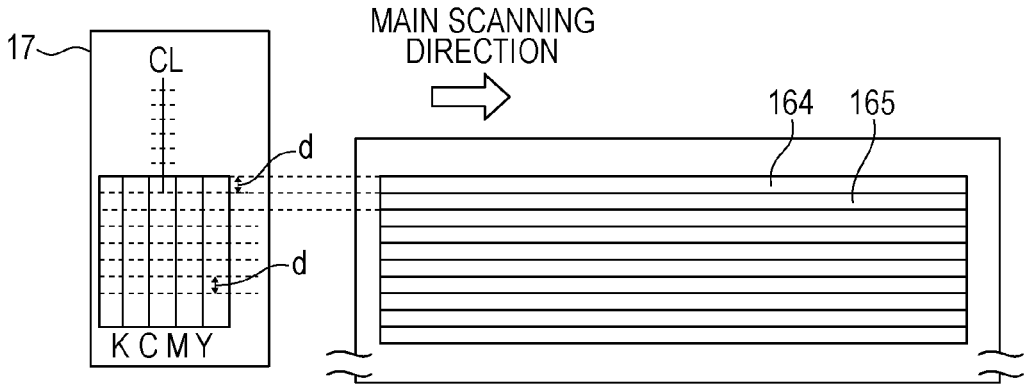

FIGS. 8A to 8C are illustrations to explain successive steps through which an image is gradually recorded on the recording medium when the multi-pass recording of 8 passes is performed by using the ink jet head 17 illustrated in FIG. 4.

FIG. 8A illustrates a state where a recording scan for the first pass is performed on a region 164 having a width d by using the color inks KCMY and the clear ink CL1. The determination as to whether the clear ink is to be applied in the recording scan for the first pass is made in accordance with the processing flow described above with reference to FIG. 5. For example, in step 103 of FIG. 5, the region 164 is divided into a plurality of unit regions, and the "ratio of haze to gloss" is calculated for each of the unit regions. The process of applying the clear ink is then controlled for each unit region. The recording process for the unit region where the clear ink is to be applied will be described below.

Of the region 164, in the primary color region of yellow with the recording density of 100% (where the amount of the applied clear ink is 20% from FIG. 6), only 1/(number of passes) (e.g., ⅛ in the embodiment) of the amount of the applied clear ink corresponding to 20% (recording density) is applied in the first pass (2.5%).

FIG. 8B illustrates a state where, after the recording scan illustrated in FIG. 8A and the operation of conveying the recording medium through the width d, a recording scan for the second pass is performed on the region 164 and a recording scan for the first pass is performed on a region 165, that is adjacent to the region 164, by using the color inks and the clear ink. At that time, in the primary color region of yellow, the clear ink is applied at 2.5% again together with the yellow ink. Thus, with the first pass and the second pass, the clear ink is applied at 5.0% in total to the primary color region of yellow. By repeating the above-described recording scans, the recording is successively performed on the regions, including 164, 165 and subsequent ones. In the individual regions, ink images are gradually completed as the recording scan is progressed.

FIG. 8C illustrates a state where recording in the ninth pass is performed on the region 164 in which a recording scan for the eighth pass has been performed and recording in relation to first and second steps (specified in Claim 1), using the color inks and the clear ink, has been completed. Thus, in each unit region, the clear ink is gradually applied and overcoated, by recording scans for the ninth to sixteenth passes, to and on the ink image that has been formed through the first and second steps. A final image is thereby formed.

Figure 9:
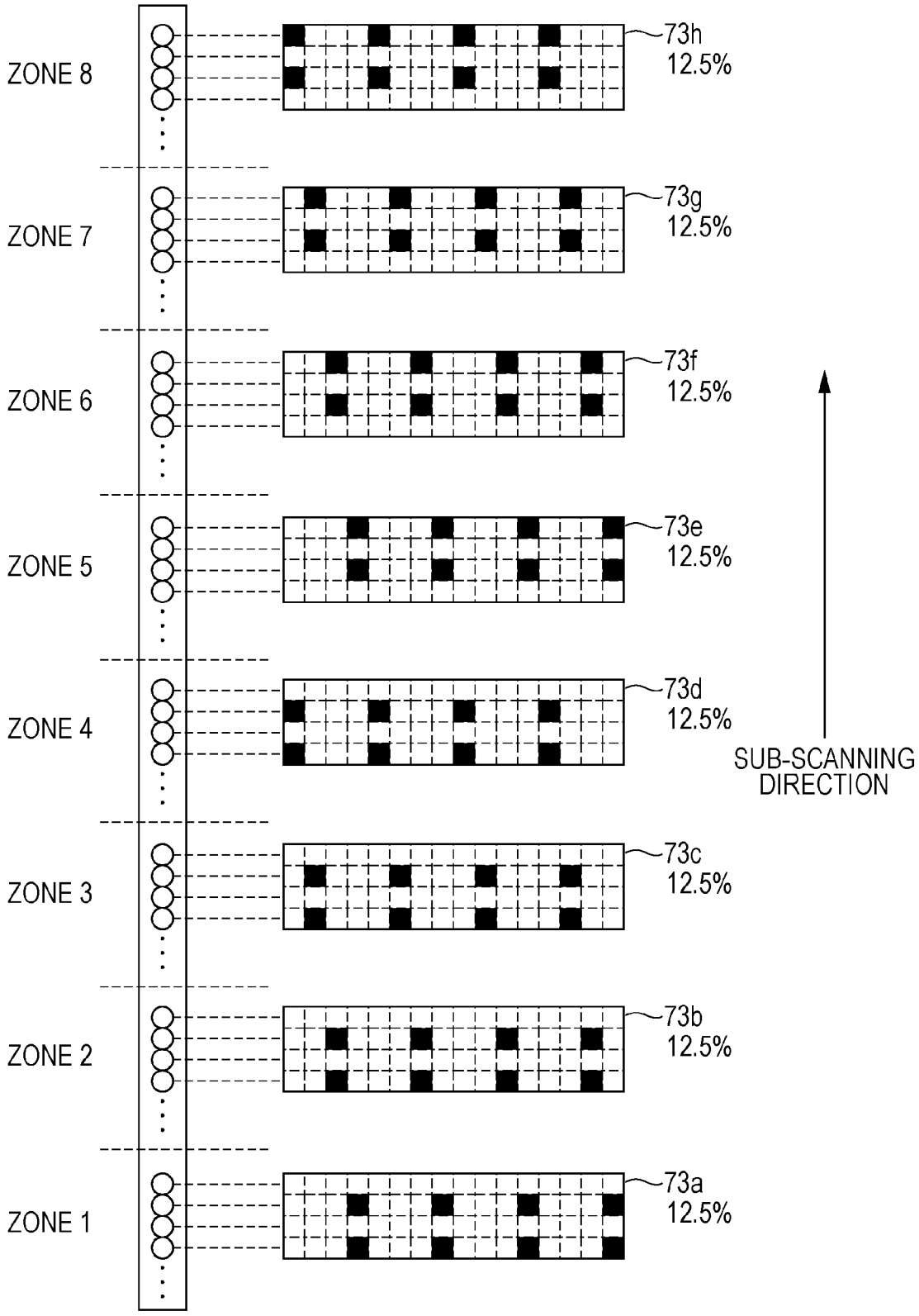
FIG. 9 is an illustration depicting mask patterns that are assigned to discharge port rows for color inks.

FIG. 9 is an illustration depicting mask patterns that are assigned to the discharge port rows 4Y to 4K for the color inks and the discharge port row 4CL1 for the clear ink in the embodiment. Because the multi-pass recording of 8 passes is performed in the embodiment, one discharge port row having 1280 discharge ports is divided into zones 1 to 8 each including 160 discharge ports. Here, mask patterns 73*a* to 74*h*, each including 16 pixels in the main scanning direction×4 pixels in the sub-scanning direction, correspond to the zones 1 to 8, respectively. Those eight mask patterns 73*a* to 73*h* are in complementary relation to one another. A recording permission rate (i.e., a percentage of recording permissive pixels included in 16 pixels×4 pixels) in each mask pattern is set to the same value of 12.5%. In other words, according to the embodiment, the recording of the color inks and the application of the clear ink to the unit region are completed with eight recording scans each corresponding to 12.5%.

Figure 10:
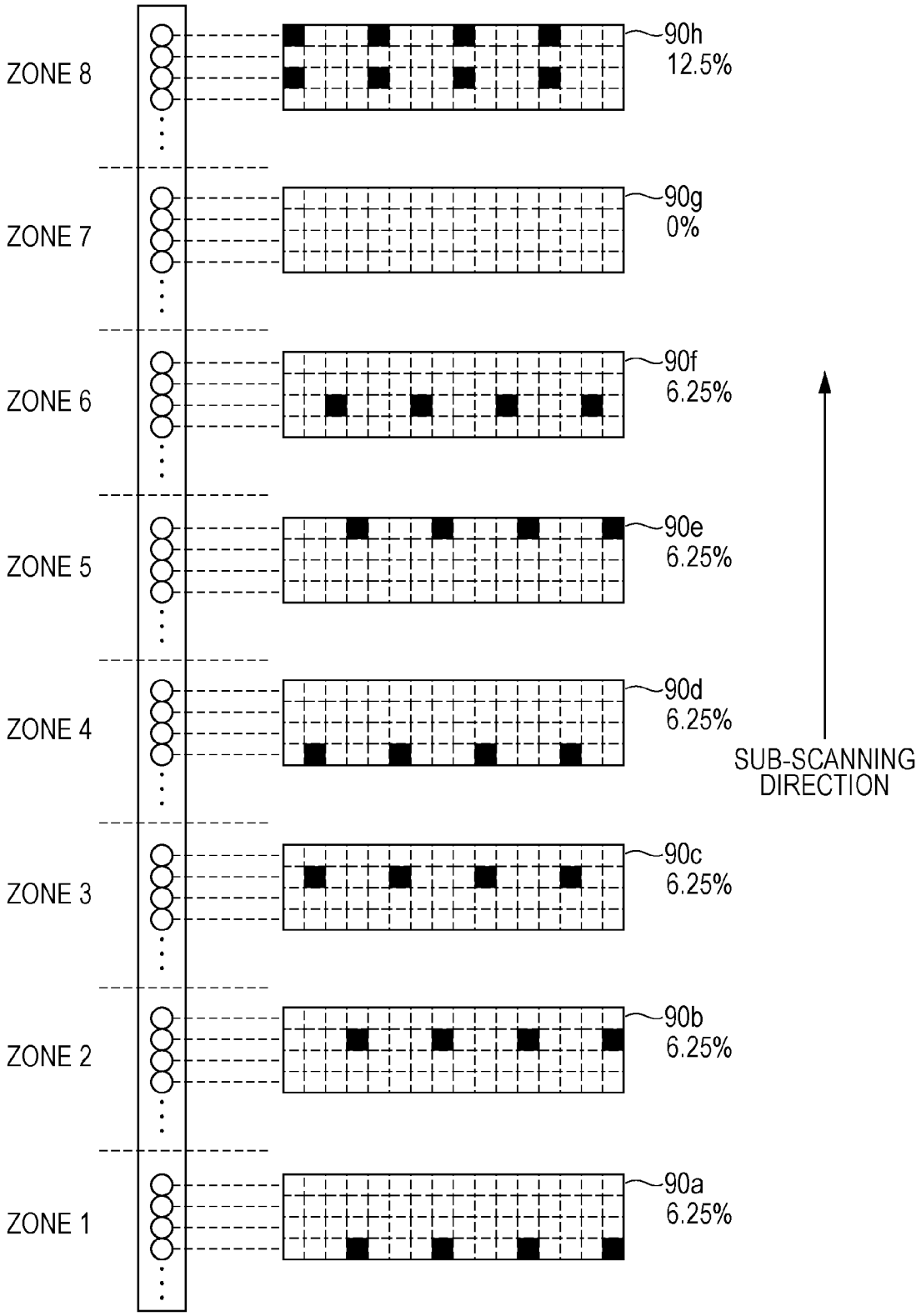
FIG. 10 is an illustration depicting a mask pattern that is assigned to a discharge port row for a clear ink.

FIG. 10 is an illustration depicting mask patterns that are assigned to the discharge port row 4CL for the clear ink in the embodiment. The discharge port row 4CL for the clear ink is also divided into zones 1 to 8 each including 160 discharge ports. Mask patterns 90*a* to 90*h* are assigned to the zones 1 to 8, respectively.

The recording permission rate set for each region (mask pattern) may be not the same for the clear ink that is applied in the second step. For example, when the amount of the applied clear ink is obtained as 50% (recording density), the recording permission rate is set to 6.25% for each of the mask patterns 90*a* to 90*f*, 0% for the mask pattern 90 g, and 12.5% for the mask pattern 90*h*. Image data is not present for the clear ink, and one dot of the clear ink is applied to each of all the pixels. Accordingly, it is to be just satisfied that total dots of the clear ink applied to the unit region, in which the "ratio of haze to gloss" is less than the predetermined threshold described above, are completely discharged in 8 passes so as to provide the amount of the applied clear ink (i.e., the recording density), which is obtained from the graph of FIG. 6.

When the multi-pass recording of 8 passes is performed by using the above-described mask patterns, the color inks and the clear ink are applied to the unit region by the discharge port rows 4Y to 4K and 4CL1 in the first to eighth passes, and the clear ink is applied to the unit region by the discharge port row 4CL2 in the ninth to sixteenth passes. Stated another way, in the embodiment, the recording in the first to eighth passes corresponds to the first step and the second step of forming an ink image by using the color inks and the clear ink, and the recording in the ninth to sixteenth passes corresponds to a third step of overcoating the ink image with only the clear ink.

FIGS. 11A to 11D are sectional views to explain, for the sake of comparison, a process in which an ink is applied to a unit region of a recording medium 1501 in a way, which provides a relatively small value of the "ratio of haze to gloss", by multi-pass recording that does not include the second step and that employs a mask pattern of related art.

Figure 11A:
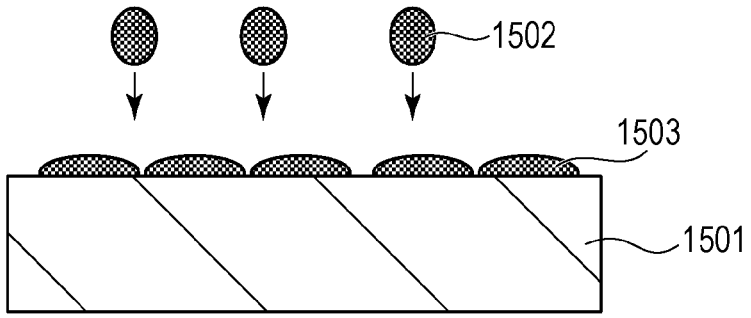
FIGS. 11A to 11D are sectional views to explain a process of forming an ink image without including a second step (specified in Claim 1).
Figure 11B:
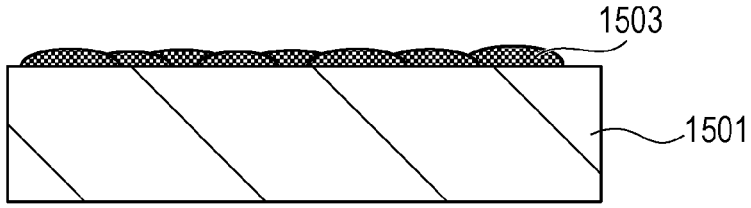

FIGS. 11A and 11B illustrate the first step of forming an ink image by successively recording color inks 1502 in the first to eighth passes. As a result of performing the recording eight times in units of 12.5%, a color ink layer 1503 is formed on the recording medium 1501 as illustrated in FIG. 11B.

Figure 11C:
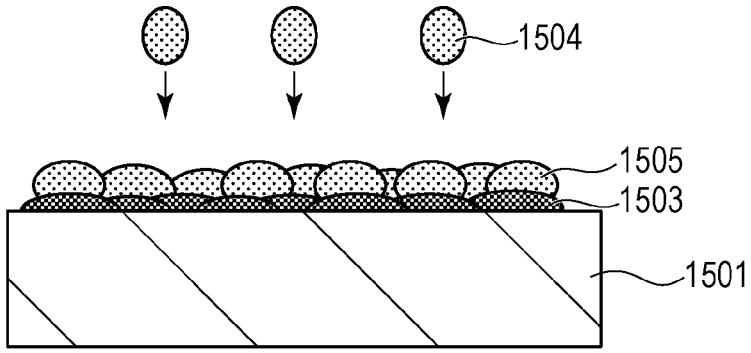
Figure 11D:
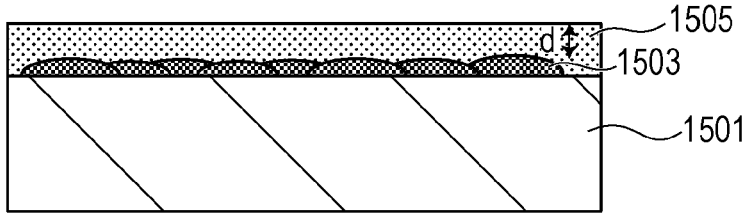

FIGS. 11C and 11D illustrate the third step of applying a clear ink 1504 for the overcoating in the ninth to sixteenth passes. Successively applied dots of the clear ink are joined together upon contacting with each other, to thereby form a clear ink layer 1505 on the color ink layer 1503. The clear ink layer 1505 thus formed is almost fixed during one pass in which the recording using the clear ink is not performed.

FIGS. 12A to 12D are schematic views to explain a recording process with the multi-pass recording that includes the second step of applying, to the unit region, the clear ink in amount corresponding information related to the type of each color ink and the amount of each color ink applied to the unit region.

Figure 12A:
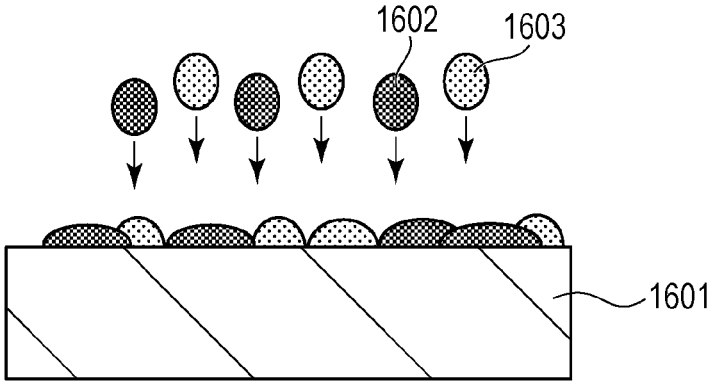
FIGS. 12A to 12D are sectional views to explain a process of, with a method including the second step, forming an ink image by applying the clear ink along with the color inks.
Figure 12B:
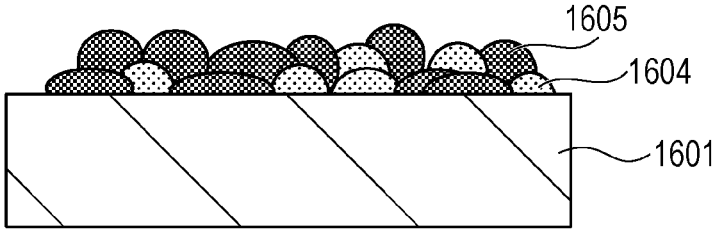
Figure 12C:
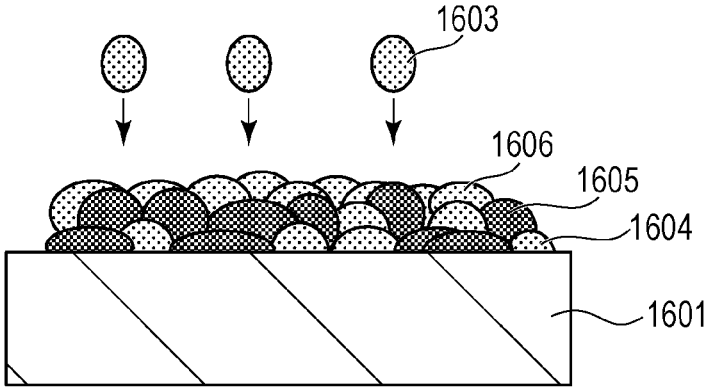
Figure 12D:
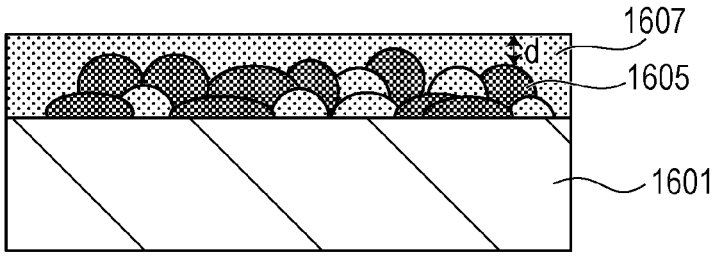

FIGS. 12A and 12B illustrates a process of discharging droplets of color inks 1602 and a clear ink 1603 to the unit region in the same scanning, and forming, on a recording medium 1601, a color ink layer 1604 having irregularities in its surface. FIGS. 12C and 12D illustrates a process of forming a clear ink layer 1606 (1607) in the third step of discharging the clear ink onto the color ink layer 1604 (i.e., an ink image) having irregularities in its surface.

As described above, the clear ink is applied to the ink image in the predetermined region of the color ink layer, which forms a smooth flat surface and provides a small value of the "ratio of haze to gloss", in the same scanning as where the color inks are applied, thereby providing irregularities on the surface of the ink image. Those irregularities cause a variation in a thickness d of the clear ink layer 1607 deposited on the ink image. As a result, there are lights having various wavelengths satisfying the formula (1), which provide a white light by being added to one another. Hence a particular interference color is not generated.

While the above description has been made in connection with the case where the clear ink is applied onto the color ink layer, the image data is not always present in all the regions, and the color inks do not always form the layer over the entire region. On the recording medium, there are not only a blank region where the color inks are not recorded, but also a low-gradation region where the color inks are slightly recorded.

In experimental studies, gloss photo paper made by CANON KABUSHIKI KAISHA (product name "Gloss Photo Paper [light] LFM-GP421R") was used as the recording medium. The amount of the applied ink was defined 100% when one dot of 4.5 pl was applied to a region of 1/1200 inch square (hereinafter referred to as "1200 dpi square"). The recording operation was performed by first applying the color inks and then applying the clear ink with the multi-pass recording of 8 passes in a state not causing a deviation in each recording region.

(Experimental Results)

Table 1, given below, indicates the "ratio of haze to gloss" for each color at different values of the recording density. Corresponding to the different values of the recording density for each color, Table 1 also indicates, in a column of "Embodiment", whether an interference color is visually recognized in a primary color image when an ink image is formed through the second step according to the embodiment. Further, Table 1 indicates, in a column of "Comparative Example", whether an interference color is visually recognized in a primary color image when an ink image is formed according to the related-art method without including the second step. A mark "×" represents the case where the interference color is visually recognized, and a mark "○" represents the case where the interference color is not visually recognized.

TABLE 1

Recording density and interference color for each color ink in embodiment and comparative example

| Type of Ink | Recording Density | Ratio of Haze to Gloss | Interference Color (Comparative Example) | Interference Color (Embodiment) |
|---|---|---|---|---|
| Black Ink | 100% | 0.45 | ○ | ○ |
| | 150% | 0.41 | ○ | ○ |
| | 200% | 0.31 | X | ○ |
| Cyan Ink | 100% | 0.22 | X | ○ |
| | 150% | 0.25 | X | ○ |
| | 200% | 0.25 | X | ○ |
| Yellow Ink | 100% | 0.24 | X | ○ |
| | 150% | 0.29 | X | ○ |
| | 200% | 0.39 | ○ | ○ |
| Magenta Ink | 100% | 0.36 | ○ | ○ |
| | 150% | 0.28 | X | ○ |
| | 200% | 0.26 | X | ○ |

As seen from the results regarding the comparative example in Table 1, in the primary color image of the black ink, the interference color is not visually recognized at the recording density of 100% and 150%, but it is visually recognized at the recording density of 200%. In the primary color image of the cyan ink, the interference color is visually recognized at all the recording densities tested. In the primary color image of the yellow ink, the interference color is visually recognized at the recording density of 100% and 150%, and it is not visually recognized at the recording density of 200%. In the primary color image of the magenta ink, the interference color is not visually recognized at the recording density of 100%, but it is visually recognized at the recording density of 150% and 200%.

As seen from the results regarding the embodiment in Table 1, the interference color is not visually recognized and original color tones are obtained in all the image regions. This is because irregularities are given, by applying the clear ink, to the ink image region where the "ratio of haze to gloss" is less than 0.35.

Further, in the region where the "ratio of haze to gloss" is not less than 0.35, the ink image is formed without applying the clear ink. Therefore, the ink image not generating the interference color can be formed without consuming the clear ink in amount more than necessary, and a cost reduction is realized.

In the embodiment described above, the threshold for the "ratio of haze to gloss" is set to 0.35 such that the clear ink is applied when the "ratio of haze to gloss" is less than 0.35, and the clear ink is not applied when the "ratio of haze to gloss" is not less than 0.35. However, a proper value of the threshold differs depending on the ink and the recording medium used, and it is optionally selected by a user. In general, the threshold may be set to a value in the range of 0.35 to 0.4.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-099695 filed Apr. 27, 2011, which is hereby incorporated by reference herein in its entirety.

What is claimed is:

1. A recording method for a recording apparatus to form a color image on a medium, the recording method comprising:

obtaining, for a region of color image data, representing the color image, divided into a plurality of regions, an index indicating ratio of haze to gloss for the region;

determining whether the haze to gloss ratio index for the region is less than a predetermined threshold;

applying ink to the region on the medium by an applying unit, wherein, in response to determining that the haze to gloss ratio index for the region is less than the predetermined threshold and before applying an overcoating member, applying ink to the region on the medium includes simultaneously applying, in a same scanning between the applying unit and the medium, droplets of color ink and droplets of clear ink from the applying unit in a way that causes the droplets of color ink and the droplets of clear ink to immingle and form a predetermined amount of ink irregularities in a surface of the color ink layer, and wherein, in response to determining that the haze to gloss ratio index for the region is not less than the predetermined threshold, applying includes refraining from using droplets of clear ink and applying the droplets of color ink to form the color ink layer without using droplets of clear ink; and applying, after ink irregularities are formed in the surface of the color ink, the overcoating member to overcoat the applied color ink and any applied clear ink.

2. The recording method according to claim 1, wherein obtaining includes further estimating a ratio of haze to gloss for that portion of an ink image that is to be formed in the region by using the color ink, wherein estimating a ratio of haze to gloss is in accordance with an information that is related to a type of the color ink and an amount of the color ink applied to the region, and wherein, in response to determining that the estimated ratio of haze to gloss is less than the predetermined threshold, applying includes applying the clear ink to the region in addition to applying the color ink and, in response to determining that the estimated ratio of haze to gloss is not less than the predetermined threshold, applying includes applying the color ink to the region and does not apply the clear ink to the region.

3. The recording method according to claim 2, wherein at least one of (i) the predetermined threshold is a value set in a range of 0.35 to 0.40 and (ii) applying the overcoating member includes forming, as the overcoating member, a clear ink layer having a thickness of at least 100 nm.

4. The recording method according to claim 1, further comprising:

discharging the color ink and the clear ink relative to the medium from an ink jet head; and repeatedly scanning the ink jet head to form the color image in the region on the medium, wherein applying the color ink to the region and applying clear ink to the region are performed in a same scanning of the ink jet head.

5. The recording method according to claim 1, wherein applying includes causing the droplets of color ink and the droplets of clear ink to immingle by discharging the droplets of color ink and the droplets of clear ink in the same scanning.

6. The recording method according to claim 1, wherein applying ink and applying the overcoating member apply ink while maintaining a thickness d of the overcoating member to within a predetermined range.

7. The recording method according to claim 1, wherein applying droplets of color ink and droplets of clear ink in a way that causes the droplets of color ink and the droplets of clear ink to immingle results in at least one droplet of clear ink being completely covered by droplets of color ink.

8. The recording method according to claim 4, wherein the overcoating member is applied to the applied color ink and any applied clear ink after scans for applying the color ink are completed.

9. The recording method according to claim 1, wherein the droplets of color ink and the droplets of clear ink immingle in a way that causes a predetermination variation in a thickness of the subsequently deposited overcoating member.

10. The recording method according to claim 1, wherein the predetermined amount of ink irregularities is such that generation of an interference color is suppressed regardless of a type of ink used and recording density.

11. The recording method according to claim 1, wherein the predetermined amount of ink irregularities is such that light interference at the overcoating member is inhibited from causing color development irrelevant to the color image regardless of a type of ink used.

12. The recording method according to claim 1, wherein the predetermined amount of ink irregularities is such that an interference color is visually recognized as white.

13. The recording method according to claim 1, wherein the overcoating member provides scratch resistance as a last layer applied to the region on the medium.

14. The recording method according to claim 1, wherein a final color image is formed immediately after the overcoating member is applied.

* * * * *